US005626038A

United States Patent [19]

Hong

[11] Patent Number: 5,626,038

[45] Date of Patent: May 6, 1997

[54] ELECTRIC WIRE ARRANGEMENT IN A WORKING MACHINE

[75] Inventor: Young-Hwan Hong, Suwon, Rep. of Korea

[73] Assignee: Samsung Electronics Co., Ltd., Suwon, Rep. of Korea

[21] Appl. No.: 426,925

[22] Filed: Apr. 21, 1995

[30] Foreign Application Priority Data

Apr. 22, 1994 [KR] Rep. of Korea ..... U. M. 94-8636

[51] Int. Cl.[6] ..... D06F 39/00

[52] U.S. Cl. ..... 68/3 R; 439/502

[58] Field of Search ..... 68/3 R, 212; 134/58 R, 134/58 D; 312/223.6; 439/502, 926

[56] References Cited

U.S. PATENT DOCUMENTS

| | | | |
|---|---|---|---|
| 4,568,401 | 2/1986 | Davis | 439/502 X |
| 4,819,459 | 4/1989 | Keith | 68/3 R |
| 4,954,101 | 9/1990 | Nelson | 439/502 |
| 5,391,088 | 2/1995 | Tomchak et al. | 439/502 X |

FOREIGN PATENT DOCUMENTS

| | | | |
|---|---|---|---|
| 57080 | 11/1988 | Japan | 68/3 R |
| 68780 | 3/1993 | Japan | 68/3 R |

*Primary Examiner*—Philip R. Coe

*Attorney, Agent, or Firm*—Burns, Doane, Swecker & Mathis, L.L.P.

[57] ABSTRACT

A control mechanism for a washing machine is electrically connected to the various units of a drive mechanism of the washing machine by a plurality of single-section conductors, each of which comprises a one-piece continuous wire extending from the control mechanism to a respective drive unit. The conductors are arranged in bundles, and each bundle is disposed in its own insulative sheath. The bundles can be attached to an inside surface of an outer body of the washing machine, or to an outside surface of a washing tub disposed within the outer body.

4 Claims, 7 Drawing Sheets

ELECTRIC WIRE ARRANGEMENT IN A WORKING MACHINE

BACKGROUND OF THE INVENTION

1. FIELD OF THE INVENTION

The present invention relates to a washing machine, and more particularly to an electric wire arrangement connecting a control means disposed at an upper portion of the washing machine to respective driving units (by way of example, motor, power transmission means, drainage means and the like) arranged thereunder.

2. DESCRIPTION OF THE PRIOR ART

A conventional washing machine, as illustrated in FIG. 1, includes a washing tub 3 disposed in a body 1 and power transmission means 13 disposed thereunder for receiving a turning effect of a motor 5 via a belt 7 to drive a spin-drying tub 9 or a pulsator 11.

In other words, the washing tub 3 houses a spin-drying tub 9 arranged on a spin-drying shaft (no reference numeral designated) of the power transmission means 13 in order to spin-dry the laundry by way of a centrifugal force generated by a driving of the motor 5. The spin-drying tub 9 houses therein the pulsator 11 arranged on a washing shaft (no reference numberal designated) of the power transmission means 13 in order to be oscillated by the motor 5 so that an eddy current can be formed in washing water stored in the spin-drying tub 9 for execution of the washing.

The body 1 of the washing machine carries with water supply means 17 for being connected to a faucet 15 through a hose 16 to thereby supply the washing water into the spin-drying tub 9, and the washing tub 3 has drainage means 19 for draining the washing water.

Furthermore, the body 1 of the washing machine has door means 23 to one end thereof hinged with a top plate 21, so that an opening of the body 1 can be closed, and the top plate 21 carries control means 25 so as to control the washing machine. The control means 25 is provided at an upper area thereof with an operation unit 27 in order to select washing conditions and the like.

In other words, the top plate 21 carries an upper electric wire body 29 consisting of a bundle of electric wires affixed by way of a plurality of attachment members 31, and the body 1 of the washing machine is provided at one side of an inner wall thereof with a first lower electric wire body 33 and a second lower electric wire body 35 consisting of bundles of electric wires 33' and 35' respectively (see FIG. 2) fixed by way of a plurality of attachment members in order to supply electric power to the motor 5, power transmission means 13, drainage means 19 and the like from the control means 25.

At this time, the plurality of attachment members 31 are mounted at predetermined intervals on an inner wall of the body 1 of the washing machine corresponding to a full length of the first lower electric wire body 33 and the second lower electric wire body 35.

Meanwhile, the first lower electric wire body 33 and the second lower electric wire body 35, as illustrated in FIG. 2, are electrically connected by releasable fittings at an approximate middle portion of the inner wall of body 1 of the washing machine.

The first lower electric wire body 33 includes respectively electric wires 33' with female connecting terminals 331, and the wires 35' of the second lower electric wire body 35 are connected with male connecting terminals 351. The male connecting terminals 351 are inserted into the female connecting terminals 331, whereupon the electric wires 33', 35' of the first lower electric wire body 33 and the second lower electric wire body 35 are electrically connected together. Thus, a plurality of conductors extend from the control means 25 to respective units of the drive mechanism, and each conductor is a multi-section conductor comprised of wires 33', 35' that are joined together by conductors 331, 351.

Furthermore, the female connecting terminals 331 and the male connecting terminals 351, inclusive of vicinity thereof, are disposed on a lump or bulge formed by folded-over portions; of the first lower electric wire body 33 and the second lower electric wire body 35, and at the same time, are sealed by a cover member 37 made of vinyle and the like in order to prevent the same from being penetrated by water.

Meanwhile, the upper electric wire body 29, the first lower electric wire body 33 and the second lower electric wire body 35, as illustrated in FIG. 3, are tightly disposed along a lower surface in the top plate 21 or the inner wall of the body 1 by the plurality of attachment members 31 fixedly arranged at a predetermined interval.

In the conventional washing machine thus constructed, when the laundry is tossed into the spin-drying tub 9 of the washing tub 3, and the washing condition is selected by operation of an operation unit 27, power is supplied to a solenoid valve of the water supply means 17 by the control of the control means 25 through electric wires of the upper electric wire body 29, to thereby supply the washing water (by way of example, warm water or cold water) to the washing tub 3 and to the spin-drying tub 9 through the water supply means 17 according to activation of the solenoid valve.

Furthermore, the motor 5 is supplied with electric power through the respective electric wires of the first lower electric wire body 33 and the second lower electric wire body 35 by the control of the control means 25, and then the power transmission means 13 is turned by the belt 7 according to the operation of the motor 5.

The turning effect is now reduced in power by the power transmission means 13 to thereafter be transmitted to the pulsator 11 and rotate the same.

At this time, the pulsator oscillates and causes the flow of the water current in the spin-drying tub 9 to form an eddy current, and at the same time, applies physical force to the laundry, so that the laundry can be pulsated in detergent for performance of the washing operation.

Meanwhile, when the washing is finished, electric power is supplied to the solenoid valve (no reference numeral designated) of the drainge means 19 through the respective electric wires of the first lower electric wire body 33 and the second lower electric wire body 35 by the cotrol of the control means 25, and the washing water (by way of example, dirty water) is drained out according to activation of the drainage means 19 by the solenoid valve.

Then, the water is supplied again through the water supply means 17 by the operation of the solenoid valve of the water supply means 17 according to the control of the control means 25, and rinsing is carried out several times.

When the rinsing operation is finished, the electric power is applied to clutch means (no reference numeral designated) of the power transmission means 13 through respective electric wires of the first lower electric wire body 33 and the second lower electric wire body 35 by the control of the control means 25, and according to the operation of the clutch means, the spin-drying tub 9 is mechanically connected to a spin-drying shaft of the power transmission means 13.

The turning effect of the motor 5 operated by the control of the control means 25 is transmitted to the spin-drying shaft of the power transmission means 13 by the belt 7, and the spin-drying tub 9 is rotated at a high speed generated by the driving of the spin-drying shaft to perform the spin-drying and then, the washing is finished.

However, there is a problem in the thus-described electric wire connecting apparatus of the conventional washing machine. The first lower electric wire body 33 employing the plurality of female connecting terminals 331 extends downwardly from the control means 25, and the second lower electric wire body 35 having the plurality of male connecting terminals 351 extends from respective driving units of the drive mechanism 50 consisting of the motor 5, power transmission means 13 and drainage means 19 disposed thereunder. Because the plurality of female connecting terminals 331 and the plurality of male connecting terminals 351 are electrically connected at an approximate mid-section in the body 1 thereof, there is a high probability of erroneous (mixed up) wirings when the female connecting terminals 331 and the male connecting terminals 351 are connected. Also it is not easy to apply the cover member 37 at that location, so the external appearance of the cover 37 can be rather unsightly, and the overall size thereof tends to be voluminous as well.

There is another problem in that because respective electric wires 33', 35' of the first lower electric wire body 33 and the second lower electric wire body 35 are exposed, coated surfaces of those electric wires can be easily damaged by imparts and vibration of the washing machine, and at the same time, leakage of the electricity may occur due to damage of the coated surfaces of the electric wires.

SUMMARY OF THE INVENTION

Accordingly, the present invention is disclosed to solve the afore-referenced problems, and it is an object of the present invention to provide a connecting apparatus to an electric wire of a washing machine by which leakage of electricity caused by damage of coated surfaces of the electric wires due to abrasion generated by vibration of the washing machine can be prevented, and at the same time, erroneous associated wirings in the course of wiring words can be avoided and unsightly external appearance thereof can be beautified.

In accordance with the object of the present invention, there is provided a connecting apparatus of an electric wire of the washing machine, the apparatus comprising:

a lower electric wire body for being connected at one end thereof to control means disposed at an upper area in the washing machine and at the same time, for being connected at the other end thereof to a driving unit disposed at a lower area in the washing machine, so that prevention can be made against leakage of electricity caused by damage of coated surfaces of the electric wire due to abrasion generated by vibration of the washing machine and erroneous associated wirings in the course of wiring works;

a female connecting terminal for being connected at one end each of the control means and the driving unit so that the lower electric wire body can be directly connected between the control means and the driving unit; and first and second male connecting terminals for being respectively provided at a lower end and an upper end of the lower electric wire body.

BRIEF DESCRIPTION OF THE DRAWINGS

For a fuller understanding of the nature and objects of the invention, reference should be made to the following detailed description taken in conjunction with the accompanying drawings in which.

A DETAILED DESCRIPTION OF THE PREFERRED EMBODIMENTS OF THE INVENTION

Figure 1:
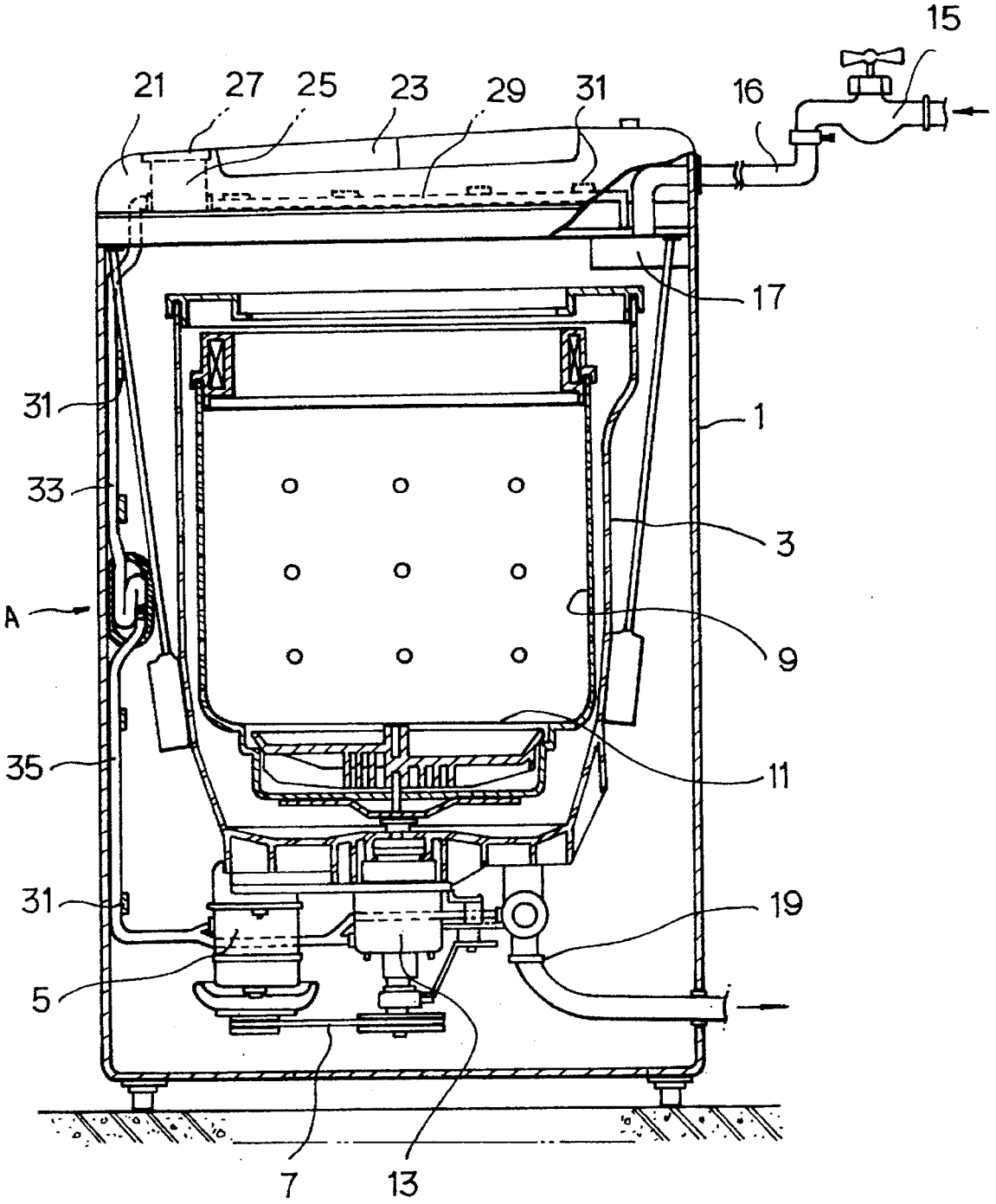
FIG.1 ( PRIOR ART )
FIG. 1 is a longitudinal sectional view of a conventional washing machine.

The embodiments of the present invention will now be described in detail with reference to accompanying drawings.

Throughout the drawings, like reference numerals are used for designation of like or equivalent parts or portions for simplicity of illustration and explanation, and redundant descriptions are omitted.

Figure 4:
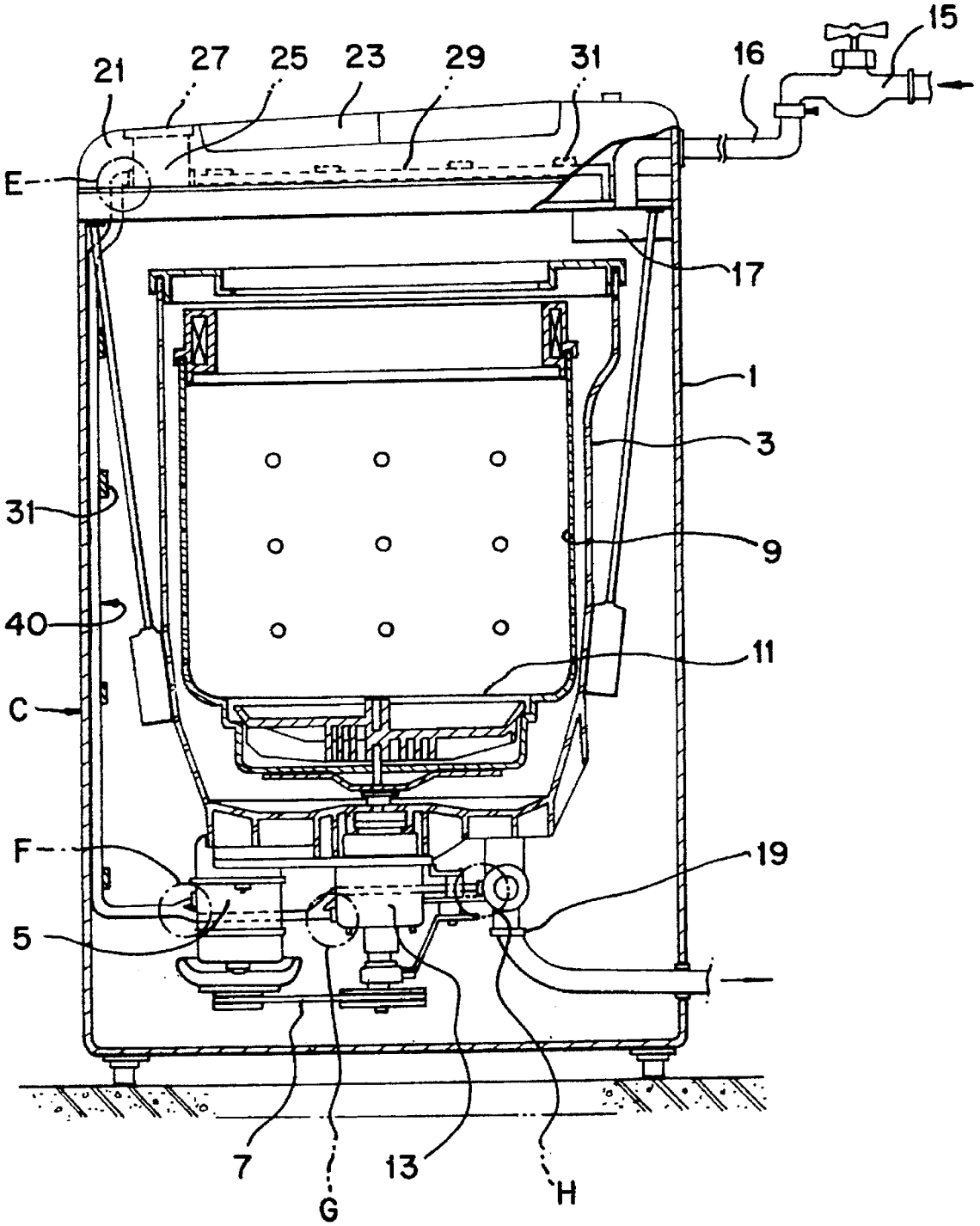
FIG. 4 is a longitudinal sectional view of a washing machine according to one embodiment of the present invention.

The body 1 of the washing machine, as illustrated in FIG. 4, has inner wall to which is attached a lower electric wire body 40 by a plurality of attachment members 31 so that the electric power can be supplied to the driving mechanism 50 comprising various drive units such as the motor 5, power transmission means 13, drainage means 19 and the like.

Figure 7:
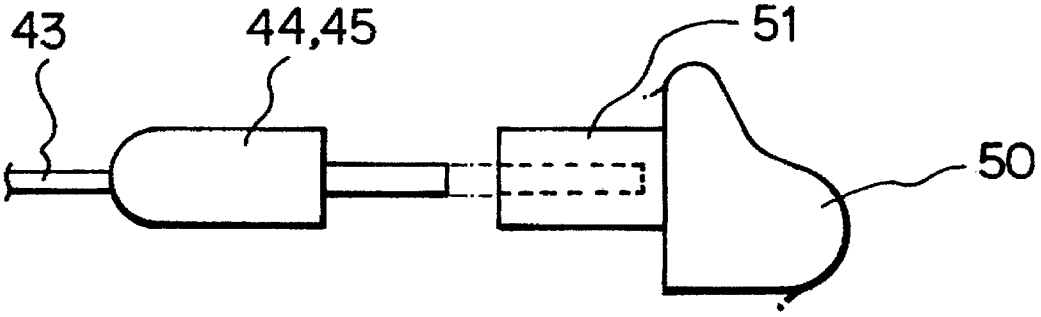
FIG. 7 is a detail diagram for illustrating portions E, F, G, and H in FIG. 4.

Each of the motor 5, power transmission means 13, the drainage means 19 and the control 25 has a female connecting terminal 51 (see FIG. 7) for connection to a lower end of the lower electric wire body 40.

Figure 5:
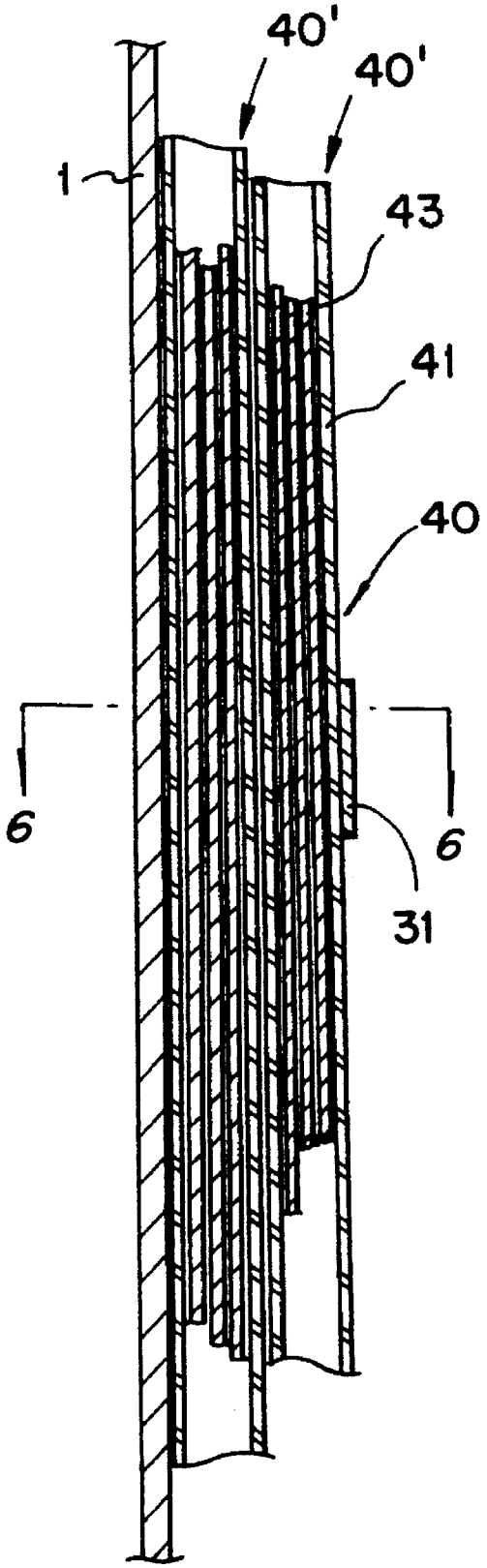
FIG. 5 is a detailed diagram for illustrating portion "C" in FIG. 4.
Figure 6:
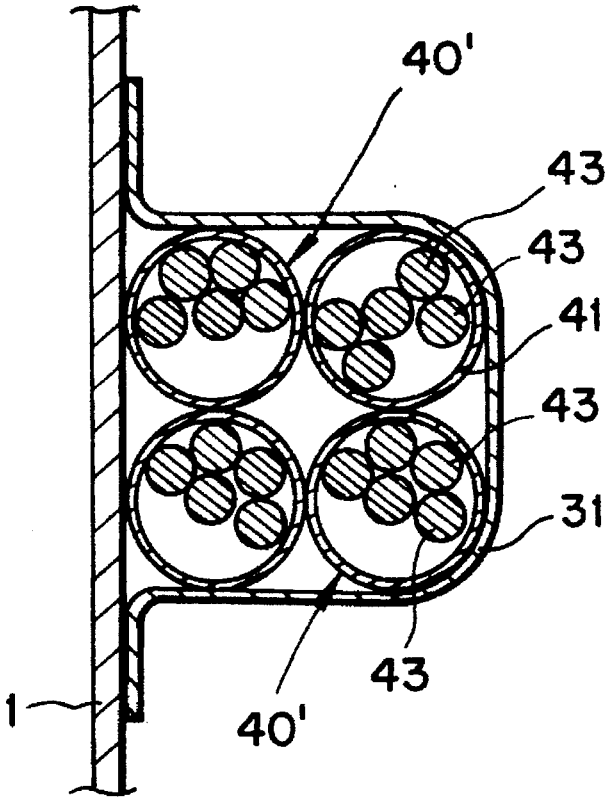
FIG. 6 is a sectional view taken along lines 6—6 in FIG. 5.

In other words, the lower electric wire body 40, as illustrated in FIGS. 5 and 6, comprises bundles 40' of electric wires 43, each bundle 40' wrapped by an insulated coating material 41, so that a coated surface of electric wire cannot be damaged by abrasion caused by vibration from the washing machine and the like. Each individual electric wire 43 is connected at one end thereof with a first male connecting terminal 44 in order to be connected to the female connecting terminal 51 of the control means 25, and at the same time, is connected at the other end thereof with a second male connecting terminal 45, so that the same can be connected to the female connecting terminal 51 of a respective one of the motor 5, power transmission means 13 and the drainage means 19.

Meanwhile, the attachment member 31 is a flexible band coated by adhesive in order to fix the lower electric wire body 40 to the inner wall of the body 1 of the washing machine.

The operation of the embodiment of the present invention thus constituted will now be described.

First of all, the female connecting terminal 51 mounted of the control means 25 is connected to the first male connecting terminal 44 formed at one end of an electric wire 43 of the lower electric wire body 40, and the female connecting terminal 51 of one of the motor 5, power transmission means 13 and the drainage means 19 is connected to the second male connecting terminal 45 arranged at the other end of the individual electric wire 43.

Then, a plurality of attachment members 31 are disposed at predetermined intervals against the inner wall of the body 1 of the washing machine along the length of the lower electric wire body 40 in order to retain the bundles 40' of wires 43 and prevent them, from being swayed by the vibration of the washing machine and the like.

Although the aforementioned description has explained one embodiment of the present invention, where the wire bundles 40' are fixed to the inner wall of the body 1 of the washing machine, it is not intended to limit the scope of this invention.

Figure 8:
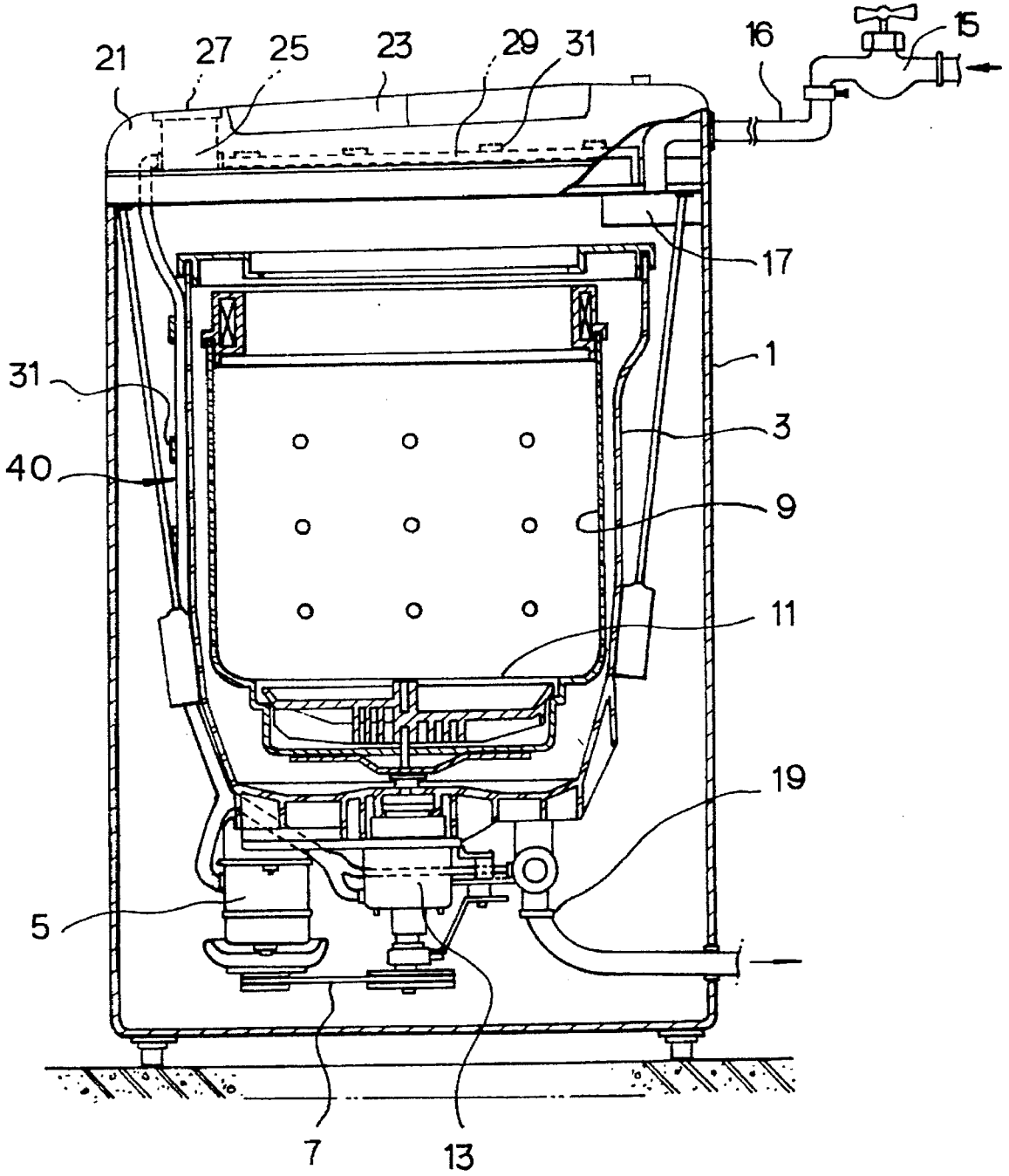
FIG. 8 is a longitudinal sectional view of a washing machine according to another embodiment of the present invention.

In another embodiment, as illustrated in FIG. 8, a plurality of lower electric wire bundles 40' are fixedly connected to an external wall of the washing tub 3 by attachment members 31 without departing from the true spirit and scope of the novel concept of this invention.

Figure 2:
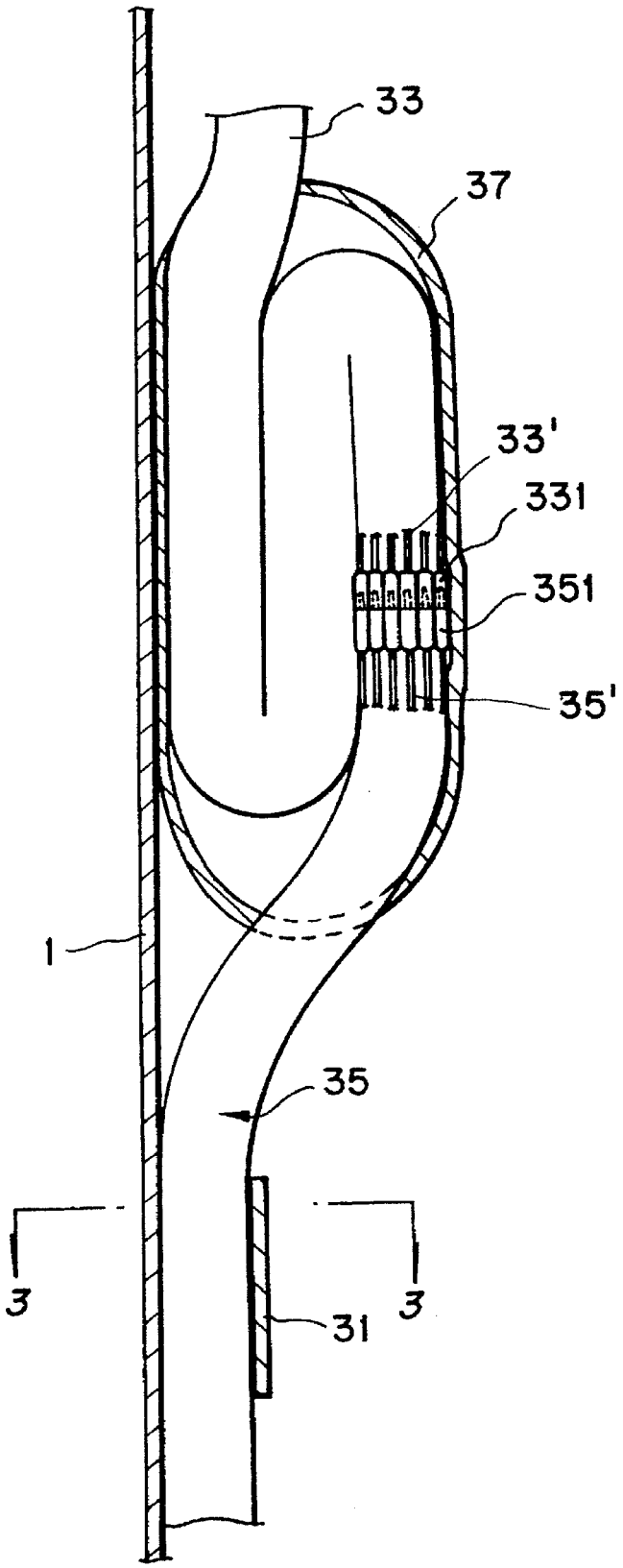
FIG.2 (PRIOR ART)
FIG. 2 is a detailed diagram for illustrating portion "A" of FIG. 1.
Figure 3:
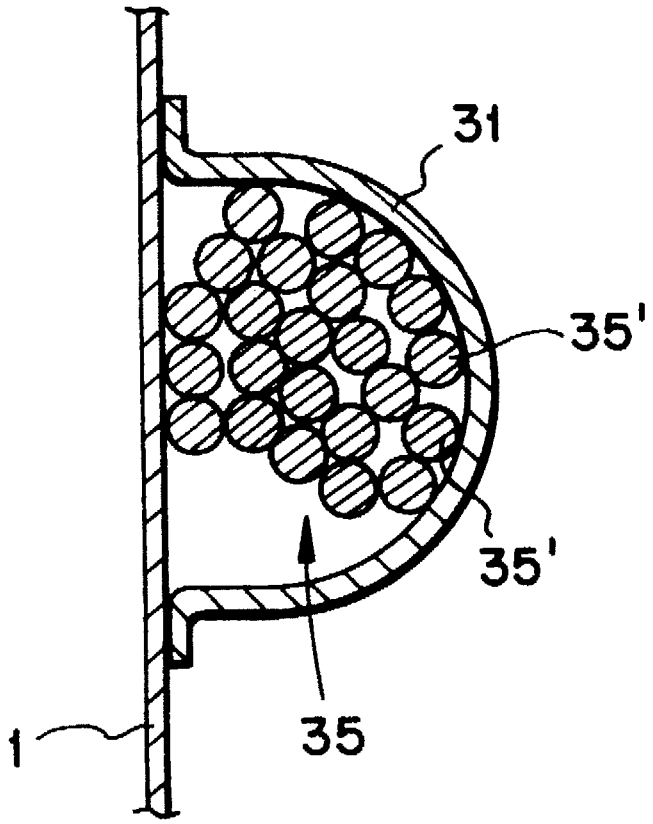
FIG.3 (PRIOR ART)
FIG. 3 is a sectional view taken along lines 3—3 in FIG. 2.

As is apparent from the foregoing, the present invention has a construction wherein a plurality of individual electric wires connect a control means to a driving unit disposed in a lower portion of the washing machine. Those wires are arranged in bundles and are wrapped by an insulated coating material, and directly connected to respective terminals of the driving unit disposed at a lower portion of the washing machine. Hence, the wires 43 can be prevented from being damaged by abrasion caused by vibration of the washing machine, to thereby avoid leakage of electricity. It will also be appreciated that the control mechanism 25 is directly connected with the units of the drive mechanism by conductors which are single-section conductors as opposed to the multi-section conductors 33', 35' of the prior art (FIG. 2). That is, each conductor of the invention constitutes a one-piece continuous wire, so there are no connectors of the type shown at 331, 351 in FIG. 2 which are required for interconnecting the sections 33', 35' of the prior art conductors. Hence, the risk of mixed-up connections is minimized.

Furthermore, in the present invention there are no bulges formed by folded-over wire sections as shown in FIG. 2, so the appearance of the wire body is more attractive.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A washing machine comprising:

a body;

a washing tub in the body;

a control mechanism mounted on the body;

a drive mechanism for the tub disposed at a lower portion of the body; and a plurality of single-section coated wires electrically connecting the control mechanism with the drive mechanism, a plurality of the wires arranged together in a first bundle, and remaining ones of the wires arranged together in at least one additional bundle, such that each bundle includes at least two wires, each of the bundles being wrapped by an insulative coating material, each single-section wire carrying a respective pair of male terminals for connection with respective female terminals of the control mechanism and drive mechanism.

2. The washing machine according to claim 1 wherein the bundles are attached to an inside surface of the body.

3. The washing machine according to claim 1 wherein the bundles are attached to an outer surface of the washing tub.

4. The washing machine according to claim 1 wherein the drive mechanism includes an electric motor.

* * * * *